US008899444B2

(12) United States Patent
Jersey

(10) Patent No.: US 8,899,444 B2
(45) Date of Patent: Dec. 2, 2014

(54) ASEPTIC TUBING CONNECTION FOR A CONTAINER

(71) Applicant: PepsiCo, Inc., Purchase, NY (US)

(72) Inventor: Steven T. Jersey, Laguna Niguel, CA (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 13/791,348

(22) Filed: Mar. 8, 2013

(65) Prior Publication Data

US 2014/0251444 A1 Sep. 11, 2014

(51) Int. Cl.
*B65D 47/06* (2006.01)

(52) U.S. Cl.
CPC ..... *B65D 47/06* (2013.01)
USPC ..... 222/1; 222/530; 222/105

(58) Field of Classification Search
USPC ..... 222/530, 539, 105, 527, 538, 509, 526, 222/529, 531, 532, 534, 535, 536, 537, 222/183; 229/117.27, 117.3; 138/114, 93, 138/89–89.4, 96 R, 118, 148, 177, 178, 117, 138/96 T; 239/288.3, 288, DIG. 12, 602, 239/588, 587.1; 285/23, 24, 55
See application file for complete search history.

(56) References Cited

U.S. PATENT DOCUMENTS

| | | | | | |
|---|---|---|---|---|---|
| 118,154 | A | * | 8/1871 | Rogers | 222/538 |
| 134,102 | A | * | 12/1872 | Schwarz | 222/538 |
| 237,884 | A | * | 2/1881 | Mainzer et al. | 222/182 |
| 2,021,411 | A | * | 11/1935 | Garrison | 222/402.16 |
| 2,574,931 | A | * | 11/1951 | Nason, Jr. | 222/105 |
| 2,831,610 | A | * | 4/1958 | Dennie | 222/105 |
| 2,861,718 | A | * | 11/1958 | Winzen | 222/105 |
| 2,954,901 | A | * | 10/1960 | Winstead | 222/183 |
| 3,078,018 | A | * | 2/1963 | Galloway | 222/183 |
| 3,087,655 | A | * | 4/1963 | Scholle | 222/183 |
| 3,089,622 | A | * | 5/1963 | Westlake, Jr. | 222/183 |
| 3,100,587 | A | * | 8/1963 | Cox, Jr. | 222/105 |
| 3,108,732 | A | * | 10/1963 | Curie et al. | 229/117.3 |
| 3,112,047 | A | * | 11/1963 | Weinreich et al. | 222/105 |
| 3,117,695 | A | * | 1/1964 | Cox, Jr. | 222/105 |
| 3,128,016 | A | * | 4/1964 | Ferri, Jr. | 222/212 |
| 3,137,415 | A | * | 6/1964 | Faunce | 222/183 |
| 3,137,419 | A | * | 6/1964 | Davy | 222/527 |
| 3,138,293 | A | * | 6/1964 | Roak et al. | 222/105 |
| 3,170,601 | A | * | 2/1965 | Daley | 222/183 |
| 3,171,573 | A | * | 3/1965 | Berney | 222/183 |
| 3,178,064 | A | * | 4/1965 | Layne | 222/105 |
| 3,190,537 | A | * | 6/1965 | Meinecke et al. | 229/5.5 |

(Continued)

OTHER PUBLICATIONS

International Search Report and Written Opinion for PCT/US2014/20128 dated Jun. 20, 2014.

*Primary Examiner* — Kevin P Shaver
*Assistant Examiner* — Michael J Melaragno
(74) *Attorney, Agent, or Firm* — Banner & Witcoff, Ltd.

(57) ABSTRACT

An assembly for aseptic connecting of a beverage ingredient container to a beverage dispensing apparatus, having a collapsible sheath of pliable material connecting the container to the dispenser at a distance away from the container. The sheath passes through a conduit of the apparatus to provide an aseptic passageway for fluid from the container to the beverage apparatus. A protective cover houses the collapsible sheath when in a collapsed configuration, and the sheath is brought to a second configuration of an extended length to provide an inner passageway of the fluid to a distal end of the sheath positioned a distance away from the container.

9 Claims, 4 Drawing Sheets

(56) References Cited

U.S. PATENT DOCUMENTS

| | | | | | |
|---|---|---|---|---|---|
| 3,191,810 | A | * | 6/1965 | Johnston | 222/183 |
| 3,199,742 | A | * | 8/1965 | Hill | 222/183 |
| 3,206,105 | A | * | 9/1965 | Smith | 383/10 |
| 3,318,505 | A | * | 5/1967 | Speas et al. | 229/103.1 |
| 3,330,448 | A | * | 7/1967 | Murphy | 222/424.5 |
| 3,599,840 | A | * | 8/1971 | Speas | 222/183 |
| 3,690,522 | A | * | 9/1972 | Chlystun et al. | 222/529 |
| 3,750,820 | A | * | 8/1973 | Labarre | 215/253 |
| 4,027,811 | A | * | 6/1977 | Chlystun | 222/529 |
| 4,066,190 | A | * | 1/1978 | Chlystun | 222/529 |
| 4,073,413 | A | * | 2/1978 | Tabler et al. | 222/529 |
| 4,133,347 | A | * | 1/1979 | Mercer | 137/240 |
| 4,219,137 | A | * | 8/1980 | Hutchens | 222/462 |
| 4,304,341 | A | | 12/1981 | Shirley | |
| 4,314,654 | A | * | 2/1982 | Gaubert | 222/83 |
| 4,322,018 | A | * | 3/1982 | Rutter | 222/83 |
| 4,355,737 | A | * | 10/1982 | Pongrass et al. | 222/81 |
| 4,422,563 | A | * | 12/1983 | Babiol | 222/153.09 |
| 4,555,048 | A | * | 11/1985 | Hamman et al. | 222/478 |
| 4,560,081 | A | * | 12/1985 | Adams | 222/529 |
| 4,568,006 | A | * | 2/1986 | Mueller et al. | 222/488 |
| 4,706,850 | A | * | 11/1987 | Remaks | 222/105 |
| 4,796,788 | A | | 1/1989 | Bond | |
| 4,817,811 | A | * | 4/1989 | Pfeiffer et al. | 222/527 |
| 4,854,349 | A | * | 8/1989 | Foreman | 138/89 |
| 4,907,724 | A | * | 3/1990 | Wing et al. | 222/105 |
| 4,919,306 | A | * | 4/1990 | Heaps et al. | 222/105 |
| 5,088,632 | A | * | 2/1992 | Odet et al. | 222/529 |
| 5,097,994 | A | * | 3/1992 | Washam | 222/527 |
| 5,577,643 | A | * | 11/1996 | Stolz | 222/529 |
| 5,601,215 | A | * | 2/1997 | Stolz | 222/529 |
| 5,636,771 | A | * | 6/1997 | Gordon et al. | 222/541.5 |
| 5,788,121 | A | | 8/1998 | Sasaki | |
| 5,934,522 | A | * | 8/1999 | Canela et al. | 222/527 |
| 6,112,949 | A | * | 9/2000 | Rhodes et al. | 222/153.02 |
| 6,273,295 | B1 | * | 8/2001 | Quartarone et al. | 222/67 |
| 6,273,869 | B1 | | 8/2001 | Vaillancourt | |
| 6,637,623 | B2 | * | 10/2003 | Muise et al. | 222/105 |
| 6,694,748 | B2 | | 2/2004 | Sergio | |
| 7,252,034 | B1 | | 8/2007 | Eckenhausen | |
| 8,561,850 | B1 | * | 10/2013 | Dawson | 222/191 |
| 2004/0007700 | A1 | * | 1/2004 | Hazel | 254/134.3 FT |
| 2008/0041882 | A1 | * | 2/2008 | Lips | 222/183 |
| 2009/0236361 | A1 | | 9/2009 | Doelman | |
| 2012/0227854 | A1 | * | 9/2012 | Zeyfang et al. | 138/96 T |
| 2014/0060530 | A1 | * | 3/2014 | Woelfel | 128/203.12 |

* cited by examiner 14
60
44
40
42
16
12
18
20
10
55
46

14
44
10
55
50
52
30
22

18
20
10
54
55
22
43

14
60
36
55
22

14
44
55
36
30
10
22
34

14
60
28
55
12
36
30
10
26
22
34

14
60
44
42
16
12
18
20
66
55
62

14
44
64
68
66
55
50
62
30
22

62
64
68
18
20
66
54
55
22
43

14
62
64
68
36
55
22
60

14
62
44
55
36
30
66
22
34

14
60
28
55
12
36
30
66
26
22
34

ASEPTIC TUBING CONNECTION FOR A CONTAINER

TECHNICAL FIELD

The disclosure relates to an assembly and method of connection of a beverage ingredient container to a beverage dispenser apparatus and, more specifically, aseptic connection of a container to a beverage apparatus.

BACKGROUND

Conventional devices for supplying beverage syrups, juices, dairy ingredients, and similar fluid beverage ingredients have a fluid-housed container being connected to a conduit associated with a beverage dispensing apparatus. It is common, for example, for the beverage ingredient fluid to be provided in a bag-in-box container that has a port or fitting that may be connected to the conduit extending from the dispenser. Such arrangements are common and beneficial, as the conduit is sometimes either chilled or heated in accordance with what is needed for the particular beverage intended and the specific fluid being delivered through the conduit from the container.

One drawback with use of such containers, however, is caused by contamination or cross-mixing of the liquids passing through the conduit that passes between the bag-in-box container and the beverage dispenser. For example, it is important for the conduit to not become contaminated and that it be properly flushed and/or cleaned between different container connections. Also, because the fluid from the container passes within the conduit, it may be necessary to be periodically flushed to inhibit contamination of the fluid in the conduit. Cleaning and flushing the conduit is time consuming, disruptive and costly. Thus, it would be advantageous to provide conventional assemblies and apparatus for dispensing beverages and existing equipment for passing the beverage ingredients through chilled or heated conduits associated with a dispenser, without the risk for contamination of cross-mixing of the fluid being delivered from a bag-in-box container. Further, it would be advantageous to provide an economical structure of a container for delivery of fluid ingredients for a beverage dispenser that provides rapid assembly and connection of the container to the apparatus, such as a beverage dispenser.

Thus, a need exists in the field for an aseptic connection of a beverage ingredient container, such as a bag-in-box container, that allows for ease of fluid connection of the container without the need to clean and/or flush the conduit line of the beverage dispensing apparatus being used. The present disclosure provides a unique structure and method of such a connection, as described herein and shown in the Figures.

SUMMARY

In an aspect of the disclosure, an assembly for aseptic connecting of a beverage ingredient container to a beverage dispensing apparatus is disclosed. The beverage ingredient container may be a bag-in-box type container that is adapted with a collapsible sheath of pliable material connecting the container to the dispenser at a distance away from the container.

In another aspect of the disclosure, a sheath linked to the container passes through a conduit of the apparatus to provide an aseptic passageway for fluid from the container to the beverage apparatus. In an embodiment, a protective cover houses the collapsible sheath when in a collapsed configuration, and the sheath is brought to a second configuration of an extended length to provide an inner passageway of the fluid to a distal end of the sheath positioned a distance away from the container.

DETAILED DESCRIPTION

In an aspect of the disclosure, a hitch may be located at a distal portion of the sheath of the assembly. The hitch may provide a link to connect an installation (or "fish") device for pulling the sheath through a conduit, and the method for expanding the sheath from the collapsed configuration to the expanded configuration by connecting the fish device to the hitch and drawing the sheath through the conduit and wherein an inner passageway is formed by fluid pressure applied to the lumen of the sheath.

In an aspect of the disclosure, pressure may be used to expand the sheath. For example, a ring may be located at a distal portion of the sheath of the assembly. The ring may be configured to prevent a pressurized gas that is placed between the sheath and a conduit and between the ring and a proximal fitting of the sheath from moving in a distal direction past the ring. Thus, the ring may be configured to be pushed in a distal direction through the conduit by a pressurized gas. As the ring is pushed in the distal direction, the ring pulls the sheath through the conduit. The ring may provide structure for pulling the sheath through the conduit using a pressurized gas. In an aspect of the disclosure, a method is provided wherein pressurized gas is placed between the sheath and a conduit and between the ring and a proximal fitting of the sheath, and as the pressurized gas pushes the ring in the distal direction, the ring pulls the sheath through the conduit. The method may be used to expand the sheath from the collapsed configuration to the expanded configuration by pushing the ring in a distal direction, and the ring draws the sheath through the conduit and wherein an inner passageway is formed by fluid pressure applied to the lumen of the sheath.

In accordance with the disclosure, the container may be any suitable container for a fluid, including but not limited to a bag-in-box type container, or a pressurized vessel, such as a polyethylene terephthalate (PET) container. The fluid may comprise a food product. The food product may comprise a beverage ingredient.

Figure 1:
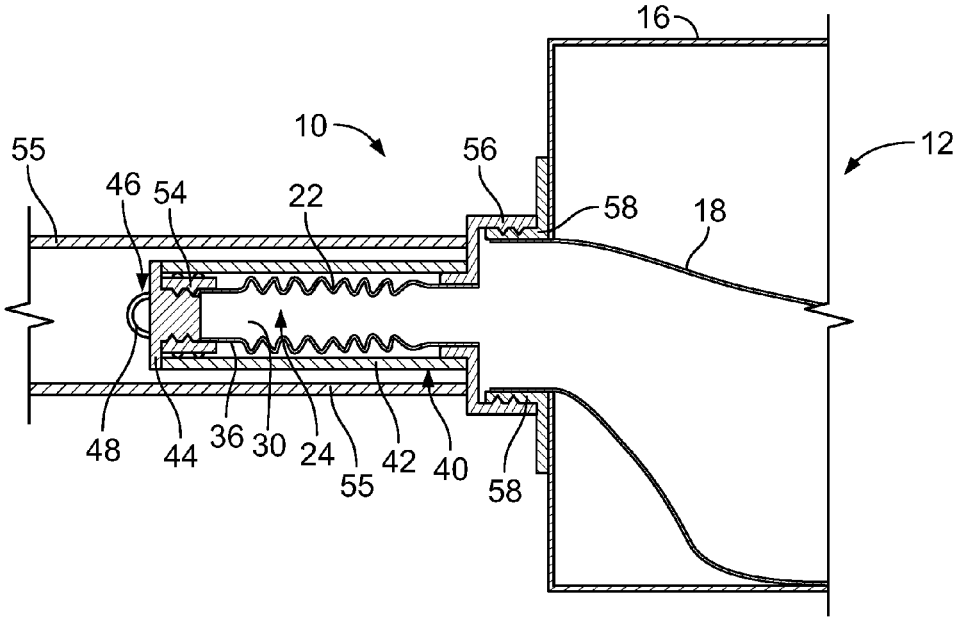
FIG. 1 is a side view of an embodiment in accordance with aspects of the disclosure.

In an embodiment of the disclosure, an aseptic connection assembly 10 is provided for a fluid container 12, such as a bag in box container, and a method of connecting the container 12 for aseptic connection to a beverage apparatus 14. The connection assembly 10 may be an integral part of the bag-in-box assembly 12, as shown in FIG. 1. In an alternate embodiment of the disclosure, the connection assembly 10 may be separately linked to a bag-in-box container 12 as a connected arrangement in the form of a combined assembly shown in the Figures, including that which is shown in FIG. 1. In either of these alternate arrangements, the combined assembly for aseptic fluid communication between the container and the beverage apparatus, described in detail below, is represented by FIGS. 1-3F, and may be employed according to the method described herein.

Figures 3A, 3B, 3C, 3D, 3E, 3F:
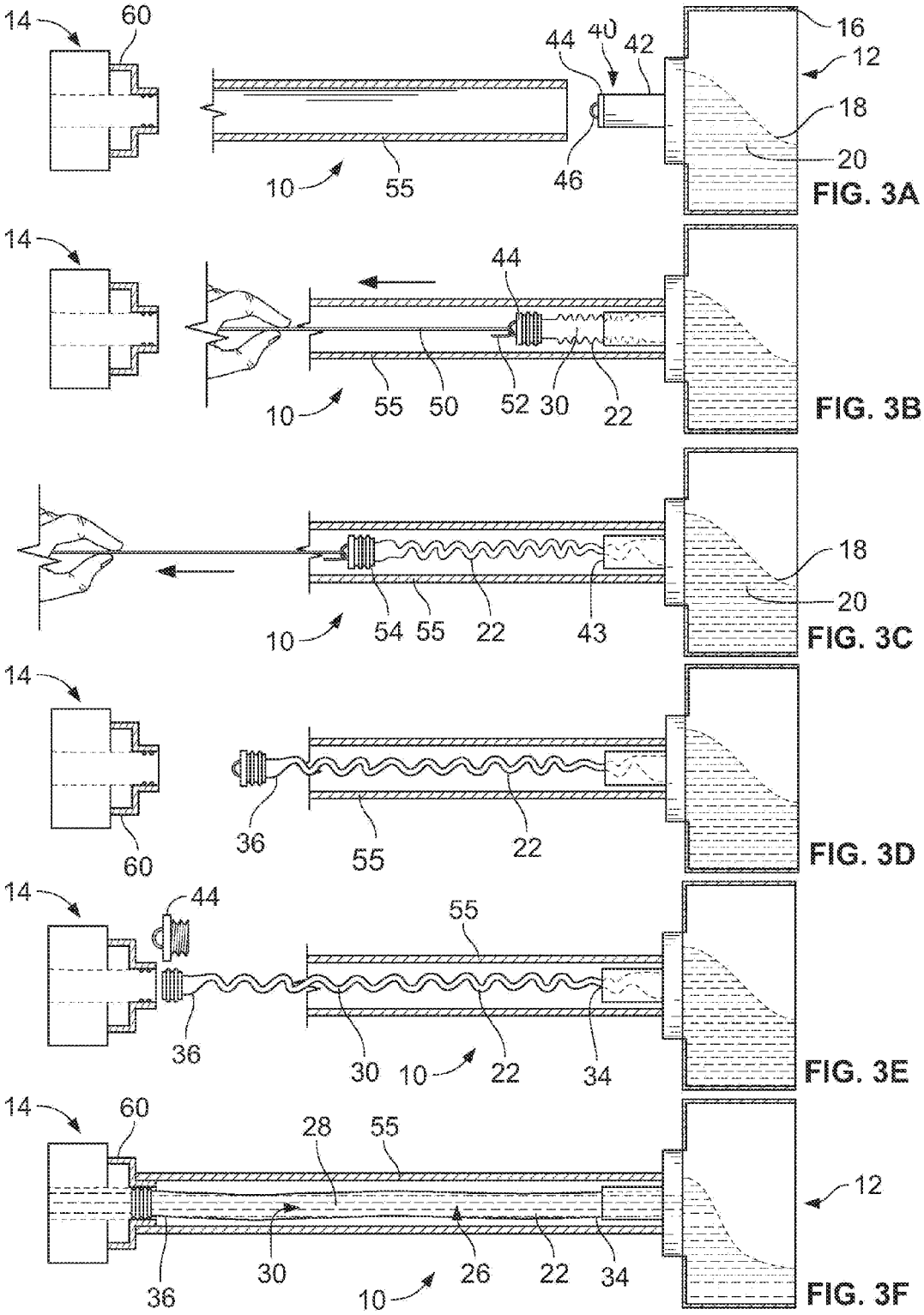
FIGS. 3A-3F show steps for expanding a sheath shown in FIG. 1 and FIG. 2 from a collapsed first configuration to an expanded second configuration.

In an aspect of the disclosure, the connection assembly 10 may be linked to a fluid container 12 which is comprised of an outer box construction 16 with an inner pliable bag 18 suitable for housing fluid 20 for dispensing from a beverage dispenser apparatus 14. A collapsible sheath 22 of pliable material may be connected to the pliable bag 18, such that fluid 20 within the bag 18 may pass into the sheath 22 when the sheath is expanded from a first configuration 24, wherein the sheath is collapsed (as shown in FIG. 1), to a second configuration 26 wherein the sheath is expanded to provide an elongated passageway 28 of the lumen 30 of the sheath tubing 22 (as shown in FIG. 3F). When the sheath 22 is expanded to provide an elongated passage way 28, such that fluid passes through the lumen from a proximal end 34 of the lumen to a distal end 36 which is attachable in fluid communication with the beverage apparatus 14.

Figure 2:
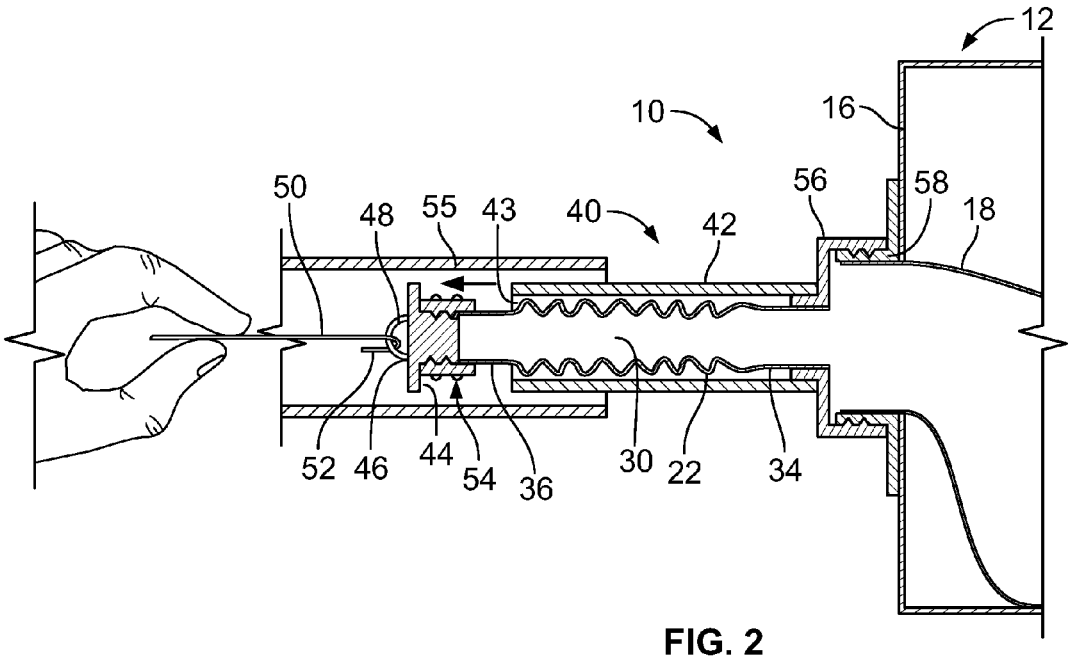
FIG. 2 is a side view of an embodiment in accordance with further aspects of the disclosure.

In another aspect of the disclosure, the assembly 10 may include a protective cover 40 that houses at least an extent of the sheath 22 when in the first configuration 24. In the embodiment shown in the FIGS. 1 and 3A, the protective cover 40 is integrally attached to the housing of the container, such as the outer box construction 16 of the container shown. Also, as shown, the protective cover 40 may comprise a protruding body 42 having an end cap 44 that is integral with the distal end 36 of the sheath 22. In an embodiment, cap 44 may include a hitch 46. The hitch 46 may be constructed with a loop 48 configured to provide a linking connection of the sheath 22 to a fish device 50, such as a linking connection provided between the loop 48 at the terminal end of the sheath 22 with a mating loop 52 of the fish device 50, as shown in FIG. 2.

In an aspect of the disclosure, distal end 36 of the sheath tubing 22 may include a distal fitting 54 at a terminal portion of the sheath 22 and which may be integrally connected to the sheath 22 to provide a connection of the elongated passageway 28 to a mating portion of the beverage dispenser apparatus 14. In an embodiment shown in the Figures, the distal fitting 54 includes a threaded arrangement for securing the end cap 44, and once the end cap is removed, the threading of the distal connector 54 may be connected to the beverage apparatus 14.

In another aspect of the disclosure, the linking connection of the fish device 50 with the sheath 22 provides a structure to removably connect the fish device 50 such that the fish device may be used to advance the sheath 22 through conduit 55 associated with the dispenser apparatus 14. In this embodiment, sheath 22 provides an aseptic passageway 28 through the conduit 55 for fluid to pass from the container 12 to the beverage apparatus 14 without the need for sterilizing or cleaning the inside of the conduit 55. The conduit 55, while useful to optionally provide a cooling or heated conduit for the fluid 20 in the container 12, is utilized without the need for cleaning or flushing the conduit as a different container is used and/or the beverages dispensed from the apparatus are changed.

In another aspect of the disclosure, at least an extent of the sheath 22 is formed of pliable plastic material which is a generally flat collapsed tube in the first configuration 24, the flat collapsed tube being folded into a compact retracted state when in the first configuration. In this embodiment, the tubing may be packed into the first configuration 24 by folding the sheath in a general Z-fold arrangement. In an alternate embodiment, the sheath 22 may be made of pliable plastic material which is packed into a compact size in the first configuration 24 with an accordion-like folding of the sheath 22. In an embodiment, the expanded sheath 22, when in the second configuration 26, may have an overall sheath length providing an elongated passageway 28 of several feet long, in distinction from the conventional devices with tubing less than a foot in length. Thus, an apparatus according to the present disclosure has a sheath compactly packed into a small space, such as the relatively short length of a protective cover 40 that may be only several inches in length, and yet the sheath 22 may be unfolded to an overall length suitable for passing through several feet of conduit 55, preferably in the range of 10 feet in length.

An alternate embodiment of the disclosure provides an aseptic tubing connection assembly 10 for connecting a beverage ingredient container 12 to a beverage dispenser apparatus 14, wherein the connection assembly is separately secured to the container 12 instead of being integrally formed with the container 12. In this embodiment, the sheath body 22 is configured to provide a proximal fitting 56 which mates to connect with a port 58 of the container 12. In the embodiment shown in the Figures, such as FIGS. 1 and 2, the mating connection of the proximal fitting 56 to the port 58 is a threaded connection which provides a friction fit of the mating connection. Those skilled in the art will realize that other connections may be utilized.

In another aspect of the disclosure, a method of aseptically connecting a bag-in-box type of package to a beverage dispenser apparatus is provided. FIGS. 3A-3F show the main steps for expanding the sheath 22 from a collapsed first configuration 24 to a second configuration 26 with the assembly 10 connected to the beverage apparatus 14. The method includes the initial step of providing a tubing assembly 10 having a collapsible sheath 22 with a proximal end 34 connected to the bag 18 within the container 12. The tubing assembly provided has a distal end 36 with a distal fitting 54 that is configured to connect to a valve portion of the beverage assembly 14, and has a hitch positioned at a terminal portion of a distal end 36. This step is shown in FIG. 3A, which provides a connection assembly 10 with a cover 40 that houses sheath 22, as is shown in cross sectional view in FIG. 1.

The method also includes the step of providing an installation tool, preferably as an elongated fish device 50, having a length configured to pass within an extent of a conduit 55 of the beverage apparatus 14, wherein the fish device 50 has a terminal end configured to connect to the hitch 46 of the tubing assembly, such as with a mating loop 52 of the fish device 50.

As shown in FIGS. 3A and 3B, the fish device 50 is connected to the hitch 46, and the fish device 50 is pulled, resulting in movement of an extent of the sheath 22 of the tubing assembly through the conduit 55. The fish device 50 and the tubing sheath 22 are additionally pulled such that the sheath 22 passes through the entire length of the conduit 55 between the container 12 and a valve portion of the beverage dispenser apparatus 14, as shown in FIGS. 3C and 3D.

In an embodiment, the distal end of the sheath 22 is thereafter connected to a valve portion of the beverage apparatus 14, after removal of an end cap 44 at the distal end of the sheath, as shown in FIG. 3E. Subsequent to connecting the distal end of the sheath 22 to the beverage apparatus, the sheath may be pressurized by inducing fluid into an inner lumen 30 of the sheath 22 such that the inner lumen 30 expands within the conduit 55 and liquid passes from the container 12 to the beverage apparatus 14. This is shown in FIG. 3F.

In an embodiment, the tubing assembly may be provided with a protective cover 40 positioned on the container 12, as shown in FIG. 3A. The cover houses the sheath 22 of the tubing assembly such that, prior to the step of pulling an extent of the tubing assembly through the conduit 55, the end cap 44 is pulled from the body 42 of the protective cover 40 to expose an opening 43 of the cover body 42 for the sheath to pass from within the protective cover 40. Thus, according to this method, the sheath 22 is expanded from a first configuration 24 collapsed within the body 42 of the protective cover 40 to a second configuration 26 in which the sheath 22 has an elongated length passing within the conduit 55 of the beverage apparatus 14. Further, as the distal end 36 of the sheath 22 is fluidly connected to the dispenser apparatus 14, such as at a valve connection 60, the pressurized sheath expands within the inner dimension of the conduit 55 to provide the elongated passageway that remains in an aseptic state, and contamination of the conduit is avoided.

Figure 4:
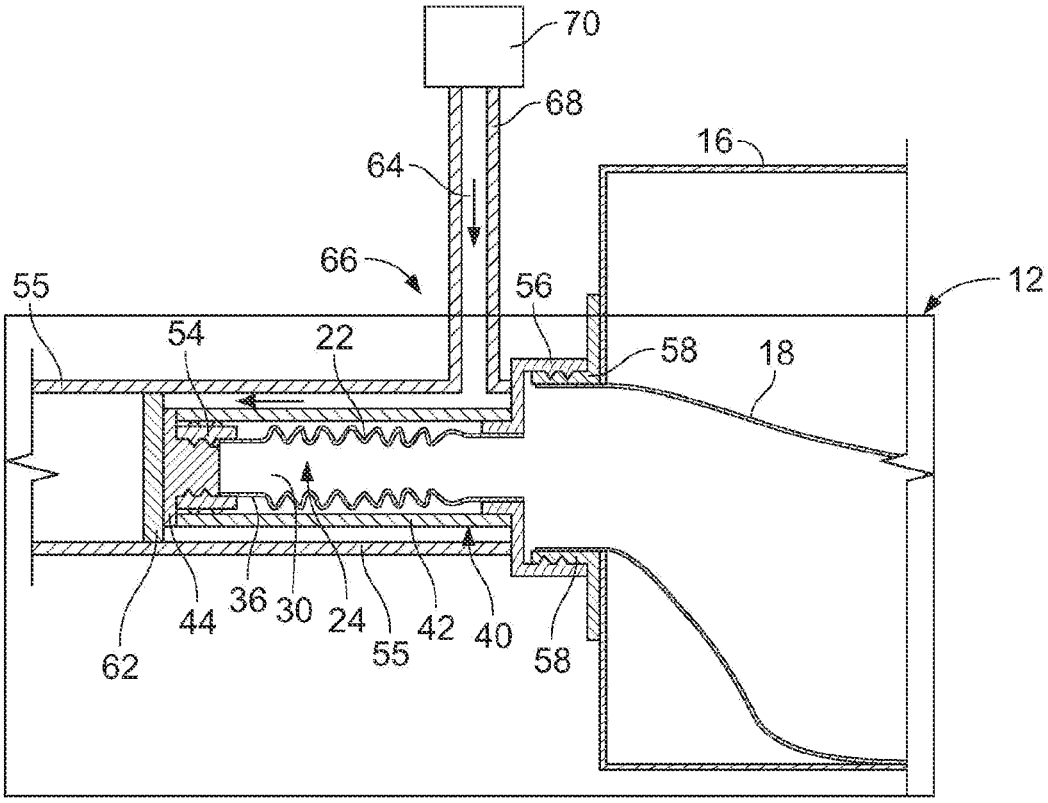
FIG. 4 is a side view of an embodiment in accordance with aspects of the disclosure.

FIG. 4 is a side view of an embodiment in accordance with aspects of the disclosure. The embodiment shown in FIG. 4 is similar to the embodiments shown in FIGS. 1, 2 and 3A-3F. Assembly 66 in FIG. 4 may be similar to assembly 10 shown in FIGS. 1, 2, and 3A-3F. In the embodiment shown in FIG. 4, a ring 62 is located at end cap 44. Ring 62 may be integral with end cap 44 or connected to end cap 44. Ring 62 may be configured to prevent a pressurized gas that is placed between ring 62 and proximal fitting 56 from moving past ring 62. Thus, ring 62 may be configured to be pushed in a distal direction through conduit 55 by a pressurized gas 64. As ring 62 is pushed in the distal direction by pressurized gas 64, ring 62 pulls sheath 22 through conduit 55. In an aspect of the disclosure, a method is provided wherein pressurized gas 64 is placed between ring 62 and proximal fitting 56, and as pressurized gas 64 pushes ring 62 in the distal direction, ring 62 pulls sheath 22 through conduit 55. The method may be used to expand sheath 22 from the collapsed configuration 24 to the expanded configuration 26 by pushing ring 62 in a distal direction, and ring 62 draws sheath 22 through conduit 55 and wherein an inner passageway 28 is formed by fluid pressure applied to lumen 30 of sheath 22. Pressurized gas 64 may be supplied through a gas line 68 from a pressurized gas source 70. Gas line 68 may be integral with proximal fitting 56 or connected to proximal fitting 56. Gas line 68 may be integral with conduit 55 or connected to conduit 55. Those skilled in the art will recognize that in accordance with the disclosure any suitable connection(s) may be utilized so that a pressurized gas pushes ring 62 in a distal direction. 55. Those skilled in the art will recognize that in accordance with the disclosure any suitable gas source may be used to provide the pressurized gas. For example, but not by way of limitation, pressurized gas source may be the same as or similar to a gas source used to provide carbon dioxide for carbonization of beverages. A gas source may comprise a pressurized vessel that is pressurized with pressurized gas.

Figure 5:
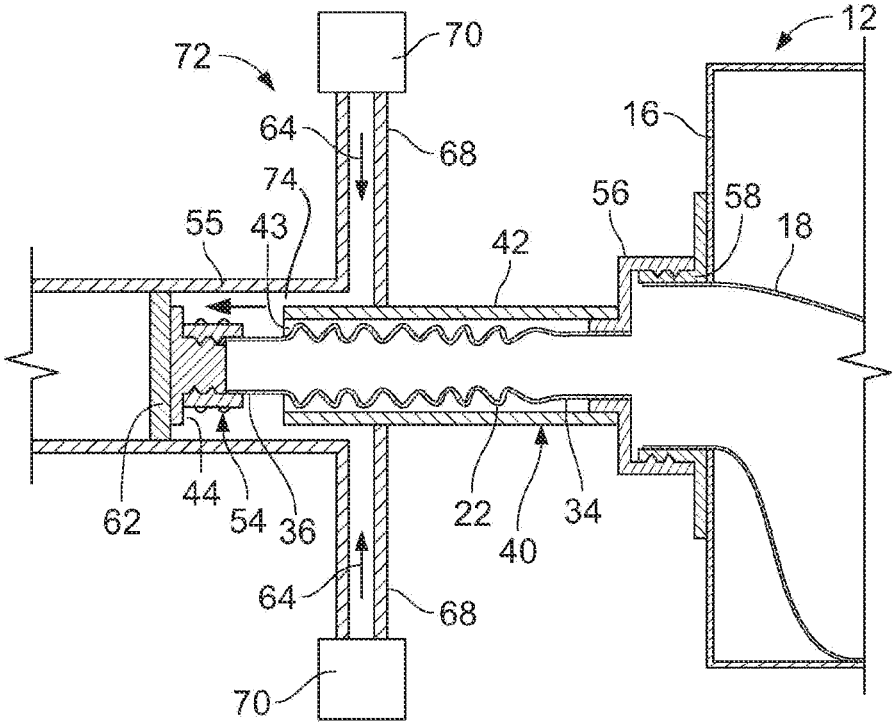
FIG. 5 is a side view of an embodiment in accordance with aspects of the disclosure.

FIG. 5 is a side view of an embodiment in accordance with aspects of the disclosure. The embodiment shown in FIG. 5 may be similar to the embodiment shown in FIG. 4. Assembly 72 in FIG. 5 may be similar to assembly 66 shown in FIG. 1. Assembly 72 may be configured so that pressurized gas 64 is provided at a proximal end 74 of conduit 55. Those skilled in the art will recognize that in accordance with the disclosure any suitable connection(s) may be utilized so that a pressurized gas pushes ring 62 in a distal direction.

FIGS. 6A-6F show steps for expanding a sheath shown in FIG. 4 and FIG. 5 from a collapsed first configuration to an expanded second configuration. The embodiment shown in FIGS. 6A-6F may be similar to the embodiment shown in FIGS. 3A-3F. FIGS. 6A-6F show steps for expanding the sheath 22 from a collapsed first configuration 24 to a second configuration 26 with the assembly 66 connected to the beverage apparatus 14. The method includes the initial step of providing a tubing assembly 66 having a collapsible sheath 22 with a proximal end 34 connected to the bag 18 within the container 12. The tubing assembly provided has a distal end 36 with a distal fitting 54 that is configured to connect to a valve portion of the beverage assembly 14, and has a ring 62 positioned at a terminal portion of a distal end 36. This step is shown in FIG. 3A, which provides a connection assembly 66 with a cover 40 that houses sheath 22, as is shown in cross sectional view in FIG. 4.

The method also includes the step of providing a pressurized gas 64 through a gas line 68 wherein pressurized gas pushes ring 62 in a distal direction through conduit 55.

Figures 6A, 6B, 6C, 6D, 6E, 6F:
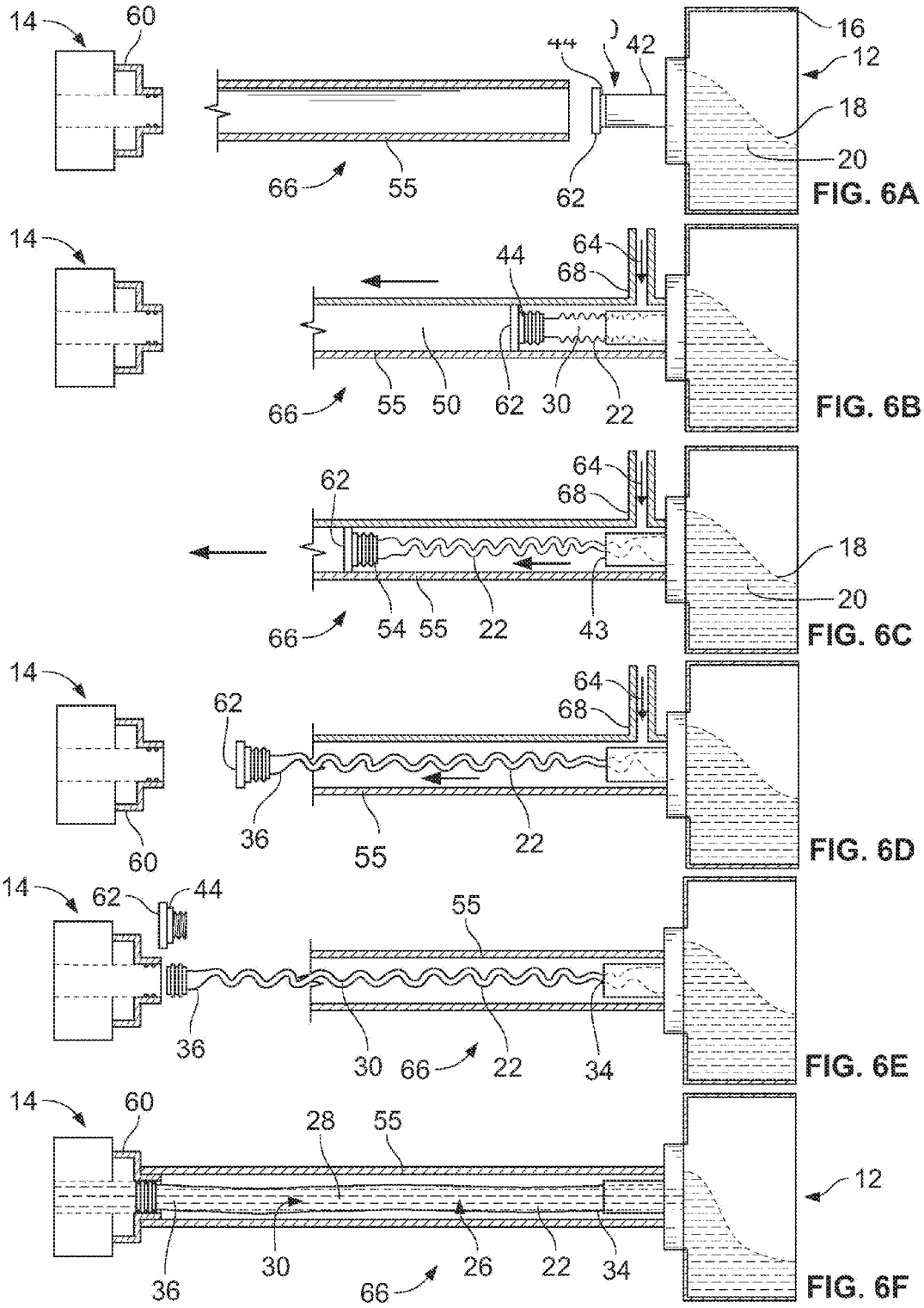
FIGS. 6A-6F show steps for expanding a sheath shown in FIG. 4 and FIG. 5 from a collapsed first configuration to an expanded second configuration.

As shown in FIGS. 6A and 6B, as pressurized gas 64 pushes ring 62 in a distal direction, ring 62 pulls end cap 44, resulting in movement of an extent of the sheath 22 of the tubing assembly through the conduit 55. End cap 44 and tubing sheath 22 are additionally pulled such that the sheath 22 passes through the entire length of the conduit 55 between the container 12 and a valve portion of the beverage dispenser apparatus 14, as shown in FIGS. 6C and 6D. In an embodiment, gas line 68 may be removed from conduit 55 after ring 62 has exited from conduit 55. Gas line 68 may be removed from conduit 55 by disconnecting gas line 68 from conduit 55.

In an embodiment, the distal end of the sheath 22 is thereafter connected to a valve portion of the beverage apparatus 14, after removal of an end cap 44 at the distal end of the sheath, as shown in FIG. 6E. FIG. 6E shows conduit 55 after gas line 68 has been removed from conduit 55. Subsequent to connecting the distal end of the sheath 22 to the beverage apparatus, the sheath may be pressurized by inducing fluid into an inner lumen 30 of the sheath 22 such that the inner lumen 30 expands within the conduit 55 and liquid passes from the container 12 to the beverage apparatus 14. This is shown in FIG. 6F.

In an embodiment, the tubing assembly may be provided with a protective cover 40 positioned on the container 12, as shown in FIG. 6A. The cover houses the sheath 22 of the tubing assembly such that, prior to the step of pulling an extent of the tubing assembly through the conduit 55, end cap 44 is pulled from the body 42 of the protective cover 40 to expose an opening 43 of the cover body 42 for the sheath to pass from within the protective cover 40. Thus, according to this method, the sheath 22 is expanded from a first configuration 24 collapsed within the body 42 of the protective cover 40 to a second configuration 26 in which the sheath 22 has an elongated length passing within the conduit 55 of the beverage apparatus 14. Further, as the distal end 36 of the sheath 22 is fluidly connected to the dispenser apparatus 14, such as at a valve connection 60, the pressurized sheath expands within the inner dimension of the conduit 55 to provide the elongated passageway that remains in an aseptic state, and contamination of the conduit is avoided.

As will be recognized by those skilled in the art, the above described embodiments may be configured to be compatible with fountain system requirements, and can accommodate a wide variety of fountain offerings, including but not limited beverages known under any PepsiCo branded name, such as Pepsi-Cola®, and custom beverage offerings.

Those of skill in the art will recognize that in accordance with the disclosure any of the features and/or options in one embodiment or example can be combined with any of the features and/or options of another embodiment or example.

The disclosure herein has been described and illustrated with reference to the embodiments of the figures, but it should be understood that the features of the disclosure are susceptible to modification, alteration, changes or substitution without departing significantly from the spirit of the disclosure. For example, the dimensions, number, size and shape of the various components may be altered to fit specific applications. Accordingly, the specific embodiments illustrated and described herein are for illustrative purposes only and the disclosure is not limited except by the following claims and their equivalents.

While embodiments of the disclosure have been illustrated and described, it is not intended that these embodiments illustrate and describe all possible forms of the disclosure. Rather, the words used in the specification are words of description rather than limitation, and it is understood that various changes may be made without departing from the spirit and scope of the disclosure.

What is claimed is:

1. A method of aseptically connecting a container to a beverage dispenser apparatus, comprising:

providing a tubing assembly having a collapsible sheath and a proximal end connected to the bag within the container, the tubing assembly further having a distal end configured to connect to a valve portion of the beverage assembly and a hitch positioned at a terminal portion of a distal end, wherein the tubing assembly is provided with a protective cover positioned on the container that houses the sheath of the tubing assembly and;

providing a fish device having a length configured to pass within an extent of a conduit of the beverage apparatus, wherein the fish device has a terminal end configured to connect to the hitch of the tubing assembly;

connecting the fish device to the hitch;

removing a cap of the protective housing to expose an opening for passage of the sheath from the protective cover and wherein the collapsible sheath is expanded from a first configuration being collapsed within the protective cover to a second configuration having an elongated length passing within a length of the conduit of the beverage assembly;

pulling an extent of the tubing assembly through the conduit such that an extent of the sheath passes through the conduit between the container and a valve portion of the beverage dispenser apparatus;

connecting the distal end of the sheath to the valve portion of the beverage apparatus; and, pressurizing the sheath by inducing fluid into an inner lumen of the sheath such that the inner lumen expands within the conduit and liquid passes from the container to the beverage apparatus.

2. A fluid connection assembly, comprising:

a container having an outer box construction with an inner pliable bag suitable for housing fluid for dispensing from a beverage dispenser apparatus;

a collapsible sheath of pliable material connected to the pliable bag, the sheath having a first configuration wherein the sheath is collapsed and a second configuration wherein the sheath is expanded to provide an elongated lumen within the sheath;

a protective cover housing the collapsible sheath when in the first configuration;

a ring positioned at a distal end of the sheath;

wherein the lumen of the collapsible sheath in the second configuration provides an inner passageway of the fluid in the bag to a distal end of the sheath positioned a distance away from the bag;

wherein the ring is configured to be pushed in a distal direction by a pressurized gas.

3. The assembly of claim 2 wherein the ring comprises a removable portion of the cover and is configured to draw the sheath through an inner passageway of a conduit.

4. The assembly of claim 3 wherein the distal end includes a cap that is removably secured to the cover, and removal of the cap provides an opening for passage of the sheath outward of the cover.

5. The assembly of claim 4 wherein the cap is secured to the cover by friction fit and the distal end of the sheath is secured to the cap.

6. The assembly of claim 4 wherein the cap is comprised of a first portion that provides a fitting connection for the distal end of the sheath and a second portion that removably covers the lumen of the sheath.

7. The assembly of claim 2 wherein the ring is positioned on an end portion of a removable cap of the protective cover, at least a portion of the cap is removable to provide an opening to the inner lumen of the sheath.

8. A method of aseptically connecting a container to a beverage dispenser apparatus, comprising:

providing a tubing assembly having a collapsible sheath and a proximal end connected to the bag within the container, the tubing assembly further having a distal end configured to connect to a valve portion of the beverage assembly and a ring is positioned at a terminal portion of a distal end;

providing a pressurized gas to a proximal portion of the ring, wherein the ring is configured to be pushed in the distal direction by the pressurized gas;

pulling an extent of the tubing assembly through the conduit such that an extent of the sheath passes through the conduit between the container and a valve portion of the beverage dispenser apparatus;

connecting the distal end of the sheath to the valve portion of the beverage apparatus; and, pressurizing the sheath by inducing fluid into an inner lumen of the sheath such that the inner lumen expands within the conduit and liquid passes from the container to the beverage apparatus.

9. The method of claim 8 wherein the tubing assembly is provided with a protective cover positioned on the container that houses the sheath of the tubing assembly and, prior to the step of pulling an extent of the tubing assembly through the conduit, the method further includes the step of removing a cap of the protective housing to expose an opening for passage of the sheath from the protective cover and wherein the sheath is expanded from a first configuration being collapsed within the protective cover to a second configuration having an elongated length passing within a length of the conduit of the beverage assembly.

* * * * *